United States Patent [19]

Plischke et al.

[11] 4,271,233

[45] Jun. 2, 1981

[54] CRIMPED POLYAMIDE FILAMENT

[75] Inventors: LeMoyne W. Plischke; William M. Baggett, both of Pensacola, Fla.

[73] Assignee: Monsanto Company, St. Louis, Mo.

[21] Appl. No.: 90,824

[22] Filed: Nov. 2, 1979

[51] Int. Cl.[3] ..... D02G 3/00

[52] U.S. Cl. ..... 428/370; 428/372; 428/374; 428/397

[58] Field of Search ..... 428/370, 369, 371, 372, 428/373, 374, 397; 264/168, 171; 260/42.56, 37 R, 42

[56] References Cited

U.S. PATENT DOCUMENTS

| | | | |
|---|---|---|---|
| 3,497,585 | 2/1970 | Chapman et al. | 264/171 |
| 3,536,802 | 10/1970 | Uraga et al. | 264/171 |
| 3,582,418 | 6/1971 | Schuur | 428/373 |

FOREIGN PATENT DOCUMENTS

| | | | |
|---|---|---|---|
| 1660165 | 5/1973 | Fed. Rep. of Germany | 264/171 |
| 45-1935 | 1/1970 | Japan | 428/370 |

*Primary Examiner*—Lorraine T. Kendell
*Attorney, Agent, or Firm*—John W. Whisler

[57] ABSTRACT

Crimped side-by-side bicomponent filaments consisting of a polyamide and $CaF_2$ are produced in which the $CaF_2$ is dispersed in only one of the components.

4 Claims, No Drawings

CRIMPED POLYAMIDE FILAMENT

BACKGROUND OF THE INVENTION

A. Field of the Invention

This invention relates to a novel crimped bicomponent filament prepared by conjugately melt spinning in a side-by-side relation polyamide components, one of which contains $CaF_2$ uniformly dispersed therein.

B. Description of the Prior Art

It is known that crimped filaments are obtained by conjugately melt spinning in a side-by-side relation two different polymers having different shrinkage properties or two chemically identical polymers having different thermal histories and, thus, different shrinkage properties. The structural heterogeneity (i.e. difference in shrinkage) in the cross-section of these filaments creates internal stresses which produce helical crimp when they are relieved. Filaments having internal stresses which when relieved produce crimp are said to have latent crimp. There are certain drawbacks involved in producing these prior art filaments, for example, one of the filaments requires the spinning of two chemically different polymers while the other filament requires subjecting each polymer to different thermal treatments just prior to melt spinning.

SUMMARY OF THE INVENTION

In accordance with the present invention a melt spun crimped side-by-side bicomponent filament is provided consisting essentially of a polyamide and $CaF_2$ and having a crimp level of at least 5 crimps per inch (197 crimps per meter) wherein the $CaF_2$ is uniformly dispersed in one of the components at a concentration of at least 200 ppm by weight of said one component and the weight ratio of the $CaF_2$-containing component to the other component is 5:95 to 70:30. The filaments may be produced by conjugately melt spinning two polyamides of the same chemical structure in a side-by-side relation to form filaments that are withdrawn from the spinneret and collected in a conventional manner, wherein: one of the polyamides contains at least 200 ppm, based on the weight of the said one polyamide, of $CaF_2$ uniformly dispersed therein; the weight ratio of the $CaF_2$-containing component to the other component is in the range of 5:95 to 70:30, respectively; and the ratio of the components, the amount of $CaF_2$ in the $CaF_2$-containing polyamide and the speed at which the filaments are withdrawn from the spinneret (referred to herein as "drawing-off speed") are correlated to provide filaments having a crimp level of at least 5 crimps per inch (197 cpm) and, preferably, 10 crimps per inch (394 cpm). Surprisingly, crimp develops in the filaments during melt spinning just below the spinneret.

The filaments are generally useful in producing textile fabrics where a soft hand is desirable, such as, apparel and carpet fabrics.

Crimp level is expressed herein in terms of crimps per inch (or meter) of filament length, the filament length being measured while the filament is under no tension (i.e. while the length of the filament is in a nonextended form as opposed to an extended form where the filament is straight and the crimp removed).

PREFERRED EMBODIMENTS OF THE INVENTION

The side-by-side bicomponent filaments of the present invention may be produced by conventional conjugate spinning techniques using commercially available spinning equipment designed for this purpose, wherein each component is subjected to the same or substantially the same thermal treatment. According to a preferred embodiment of the invention the components are separately melted and joined to form a stratified flow of melts which is then extruded through a spinneret assembly, without intimate mixing of the components, to form molten filaments which are withdrawn from the spinneret at a given rate (i.e. drawing-off speed). As the molten filaments move away from the spinneret they cool to form solid filaments and also attenuate (neck down) to a finer denier. Attenuation of the molten filaments imparts a jet stretch and molecular orientation thereto. The extrusion rate and drawing-off speed are adjusted (i.e. correlated) to provide filaments of a desired denier.

Several processing variables have been observed to have an influence on the crimp level of the filaments. The following discussion considers changing and/or the effect of only one variable at a time while leaving all other variables constant and has reference to using nylon 66 (polyhexamethylene adipamide) as the polyamide.

$CaF_2$ Concentration

It has been observed that at low concentrations of $CaF_2$ in the $CaF_2$-containing polyamide (e.g. 200 ppm) higher drawing-off speeds are required to achieve a given crimp level than when the $CaF_2$ concentration is 2000 ppm. Stated different as the $CaF_2$ concentration increases from a low level (e.g. 200 ppm), the crimp level also increases. However, increasing the $CaF_2$ concentration above about 2000 ppm has not been observed to further significantly increase the crimp level. Therefore, in the interest of cost savings, $CaF_2$ concentrations above about 2000 ppm are not recommended although, if desired, higher concentrations (e.g. 8,000 to 12,000 ppm or higher) may be used.

Component Ratio

It has been observed that the crimp level increases to a maximum level and thereafter decreases as the weight ratio of the component is varied from 0:100 to 100:0, with the highest crimp level being obtained with a weight ratio between 35:65 and 65:35, $CaF_2$-containing component to the other component. In general, in order to provide a filament having a crimp level of 5 cpi (197 cpm) or higher, the weight ratio of the components must be with the range of 5:95 to 70:30, $CaF_2$-containing component to the other component.

Drawing-Off Speed

In general, increasing the drawing-off speed increases the crimp level and reduces the denier of the filaments and also, of course, increases the molecular orientation of the filaments. Preferably, drawing-off speeds of at least 1500 ypm (1372 m/min), and most preferably at least 2500 ypm (2286 m/min), are used.

Quench

The use of a cross-flow of air to assist in cooling the molten streams tends to increase the crimp level of the resulting filaments. Generally, where a large number of filaments are being quenched, the freshly extruded filaments are solidified in a quenching chamber (chimney) positioned just below the spinneret through which the filaments are passed and subjected to the cross-flow of air.

Filament Cross-Section

Higher crimp levels are obtained with filaments having a non-round cross-sectional shape, for example, filaments of a Y-shaped, trilobal-shaped or triskellion-shaped cross-section.

Polyamides which may be used in producing the filaments of the invention are fiber-forming and include nylon 66 (polyhexamethylene adipamide) and nylon 6 (polycaprolactam) and copolyamides formed by the condensation of two or more diamines with one or more dicarboxylic acids or vice versa, such as, the condensation product of adipic acid, terephthalic acid and hexamethylene diamine (i.e. nylon 66/6T) and the condensation product of adipic acid, caprolactam and hexamethylene diamine (i.e. nylon 66/6). Preferred copolymers are nylon 66/6, nylon 66/6T and nylon 66/6/6T wherein at least 88 mole % of the copolymer are hexamethylene adipamide units. Nylon 66 and nylon 6 are particularly preferred polyamides since they are widely used commercially in producing textile filaments.

EXAMPLE 1

This example illustrates two procedures for preparing $CaF_2$-containing nylon 66 which may be suitably used in producing the filaments of the present invention.

Procedure A $CaF_2$ was prepared by the addition of 685.3 grams (2.905 moles) of calcium bromide dihydrate to 546.9 grams (2.905 moles) of potassium fluoride dihydrate and 14061.29 grams of water to a stainless steel vessel equipped with a mechanical stirrer. The resulting aqueous $CaF_2$ slurry was stirred without interruption until it was ready for use so as to prevent $CaF_2$ from precipitating. The total weight of the slurry was 33.7 lbs (15.3 Kg).

A stainless steel autoclave adapted for batch polymerization of nylon 66 was filled with nitrogen gas and was thereafter charged with 596.9 (270.7 Kg) of an aqueous solution containing 48.55% by weight of hexamethylene diammonium adipate (nylon 66 salt). The contents of the autoclave were heated to a temperature of 200° C. under 250 psig ($1825.0\times10^3$ newtons/$m^2$) pressure at which time the above prepared $CaF_2$ slurry was added thereto. Heating of the contents continued until the nylon-forming materials in the autoclave reached a temperature of 243° C. At this stage bleeding off of water vapor was begun to reduce the pressure in the autoclave to atmospheric pressure. During this pressure reduction stage which lasted 40 minutes, the polymer temperature was gradually increased to 270° C. The molten polymer was then held at this temperature for twenty minutes to bring the polymer to equilibrium. At the end of the twenty-minute holding period, the polymer was extruded in the form of a ribbon onto a casting wheel where it was quenched with water. Thereafter, the ribbon was cut into chips suitable for melt spinning into filaments. The chips consisted of nylon 66 (250 lbs/113.4 Kg) containing uniformly dispersed therein 2000 parts by weight of $CaF_2$ per million parts of nylon 66.

Procedure B

A batch of chips was prepared using Procedure A except that in this instance $CaF_2$ slurry was omitted from the autoclave. The resulting nylon 66 chips were divided into two portions of equal weight. One of the portions was added to a twin-shell, cone-shaped blender along with 4,822 ppm, based on the weight of the portions of $KF.2H_2O$. The ingredients were then blended to provide nylon 66 chips coated with $KF.2H_2O$. Then the other portion was coated with 6,043 ppm of $CaBr.2H_2O$ by the same technique. The two portions were then both added to the blender and mixed together. When the resulting blended coated chips are melted with stirring, the $KF.2H_2O$ reacts with the $CaBr.2H_2O$ in the molten nylon 66 to provide molten nylon 66 containing 2000 ppm of $CaF_2$ uniformly dispersed therein. The resulting $CaF_2$-containing molten nylon 66 may then be directly fed to a conjugate melt spinning assembly where it is combined with molten nylon 66 and extruded to form filaments of the invention or it may be extruded into particulate form for subsequent use.

The amounts of ingredients may be varied to provide for different $CaF_2$ concentrations. Also $CaF_2$-containing nylon 66 of a given $CaF_2$ concentration can be blended with appropriate amounts of nylon 66 to provide a desired $CaF_2$ concentration.

EXAMPLE 2

This example illustrates the production of filaments of the present invention.

Two components were separately heated to 270° C. and melted, and conjugately spun at 270° C. in a conjugate ratio of 1:1 (by weight) in a side-by-side relation through a 34-hole (triskellion-shaped) spinneret to obtain molten streams. One component (A) was nylon 66 modified to contain 2000 ppm of $CaF_2$ uniformly dispersed therein using Procedure A described in Example 1 and the other compound (B) was simply nylon 66 (i.e. unmodified nylon 66). The filaments were passed through a chimney positioned just below the spinneret in which they were subjected to a cross-flow of air (450 cfm, or 12.7 $m^3$/min) and quenched. The solidified filaments were withdrawn from the chimney at a rate (drawing-off speed) of 1350 ypm (1234 m/min). The resulting filaments had a significant amount of crimp and were of a triskellion cross-sectional shape with a modification ratio (MR) of 1.4. When the experiment was repeated under identical conditions except a drawing-off speed of 300 ypm (274 m/min) was used instead of 1350 ypm (1234 m/min), the resulting filaments were not crimped. The results are summarized in Table I.

TABLE I

| Sample | A:B wt % | Drawing-Off Speed ypm (m/min) | MR | Crimp |
|---|---|---|---|---|
| A | 50:50 | 1350 (1235) | 1.4 | yes |
| B | 50:50 | 300 (274) | 1.4 | no |

EXAMPLE 3

This example illustrates the effect of drawing-off speed on crimp level.

Three samples of side-by-side bicomponent yarns (34 filaments) were made as described in Example 2, except in this instance the drawing off speed was 2500 ypm (2286 m/min) (sample C), 3400 ypm (3109 m/min) (sample D) and 4500 ypm (4115 m/min) (sample E). It was observed that as the drawing-off speed increased the crimp level also increased.

EXAMPLE 4

This example illustrates the effect of component ratio and cross-sectional shape on crimp level.

Samples of 34-filament bicomponent yarn were prepared at a drawing-off speed of 4500 ypm (4115 m/min) using the apparatus and procedure described in Example 1, except that the component ratio and cross-sectional shape of the filaments were varied as indicated in Table II below. Crimp per inch values given in the table represent the average of several random determinations (at least five).

TABLE II

| Sample | A:B wt % | dpf | Cross-Section Round | Cross-Section Triskellion | Crimp cpi(m) |
|---|---|---|---|---|---|
| F | 0:100 | 4.1 | yes | — | 4.1(161) |
| G | 40:60 | 4.5 | yes | — | 18.6(732) |
| H | 50:50 | 4.9 | yes | — | 11.0(433) |
| I | 100:0 | 4.4 | yes | — | 4.2(165) |
| J | 0:100 | 3.6 | — | yes | 4.6(181) |
| K | 50:50 | 4.3 | — | yes | 21.1(831) |
| L | 60:40 | 4.3 | — | yes | 14.4(567) |

The results in Table II shows that as the ratio of A to B ($CaF_2$-containing component to other component) increases, the crimp level increases to a maximum level and thereafter decreases. The results also show that a higher crimp level is obtained with filaments of a triskellion rather than round cross-section. The data also indicate that maximum crimp level is obtained with filaments of a round cross-section at a lower A to B component ratio than with filaments of a non-round cross-section.

EXAMPLE 5

In this example two samples of 34-filament bicomponent yarn (round cross-section) were prepared using the same apparatus and procedure described in Example 1 except that one of the samples (Sample M) contained 200 ppm $CaF_2$ and the other sample (Sample N) contained 2000 ppm $CaF_2$. The $CaF_2$-containing component was made according to Procedure B described in Example 1. Each yarn sample was prepared at a drawing-off speed of 4500 ypm (4115 m/min) using a 1:1 component weight ratio. The crimp level of the samples was determined and found not to be significantly different. The crimp levels were 7.7 cpi (303 cpm) and 8.2 cpi (323 cpm), Sample M and Sample N, respectively. The results indicate that a high drawing-off speeds such as used in preparing these yarn samples, lower concentrations of $CaF_2$ may be used.

We claim:

1. A melt spun crimped side-by-side bicomponent filament consisting essentially of a polyamide and $CaF_2$ and having a crimp level of at least 5 crimps per inch, wherein said $CaF_2$ is uniformly dispersed in one of the components at a concentration of at least 200 parts per million by weight of said one component and the weight ratio of the $CaF_2$-containing component to the other component is between 5:95 and 70:30.

2. The filament of claim 1 wherein the weight ratio is between 35:65 and 65:35.

3. The filament of claim 2 wherein the polyamide is polyhexamethylene adipamide.

4. The filament of claim 3 having a crimp level of at least 10 crimps per inch.

* * * * *